US005863299A

United States Patent [19]

Holt et al.

[11] Patent Number: 5,863,299

[45] Date of Patent: Jan. 26, 1999

[54] METHOD FOR REMOVING WATER SPOTS FROM FABRICS

[75] Inventors: John Henry Holt, North Bend, Ohio; Stephanie Kay Jones, Lawrenceburg, Ind.

[73] Assignee: The Procter & Gamble Company, Cincinnati, Ohio

[21] Appl. No.: 8,670

[22] Filed: Jan. 16, 1998

[51] Int. Cl.[6] ..... D06L 1/00; D06L 1/02

[52] U.S. Cl. ..... 8/142; 8/137; 510/285; 510/295; 510/296; 510/282; 510/283; 510/284; 510/281; 38/144

[58] Field of Search ..... 8/137, 142; 510/285, 510/295, 296, 282, 283, 284, 281; 38/74, 77.1, 144

[56] References Cited

U.S. PATENT DOCUMENTS

| | | | |
|---|---|---|---|
| 2,056,141 | 9/1936 | Myers | 8/142 |
| 2,061,211 | 11/1936 | Reddish | 8/142 |
| 4,692,277 | 9/1987 | Siklosi | 510/432 |
| 5,238,587 | 8/1993 | Smith et al. | 510/281 |
| 5,547,476 | 8/1996 | Siklosi et al. | 8/142 |
| 5,591,236 | 1/1997 | Roetker | 8/137 |
| 5,630,847 | 5/1997 | Roetker | 8/137 |
| 5,630,848 | 5/1997 | Young et al. | 8/137 |
| 5,632,780 | 5/1997 | Siklosi | 8/137 |
| 5,658,651 | 8/1997 | Smith et al. | 442/59 |
| 5,681,355 | 10/1997 | Davis et al. | 8/137 |
| 5,746,776 | 5/1998 | Smith et al. | 8/142 |
| 6,630,848 | 5/1997 | Young et al. | 8/142 |

FOREIGN PATENT DOCUMENTS

| | | |
|---|---|---|
| 429172 | 10/1990 | European Pat. Off. . |
| 2302553 | 1/1997 | United Kingdom . |

*Primary Examiner*—Alan Diamond
*Attorney, Agent, or Firm*—S. Robert Chuey; Kim W. Zerby; Jacobus C. Rasser

[57] ABSTRACT

A method for removing a water spot from a fabric article, wherein the fabric article has a first side and a second side and the water spot is on the first side. The method comprises the steps of:

a) placing a clean cloth on a hard flat surface;

b) placing the fabric article on the clean cloth such that the first side of the fabric article contacts the clean cloth;

c) dampening the fabric article with an aqueous solution; and d) ironing the second side of the fabric article adjacent the water spot with a clothes iron.

This method is preferably performed in conjunction with a non-immersion method for cleaning and refreshing fabric articles. Also, a product for treating fabric articles is provided, which product includes instructions for performing the method of removing water spots.

9 Claims, No Drawings

METHOD FOR REMOVING WATER SPOTS FROM FABRICS

TECHNICAL FIELD

This invention relates to a method of removing water spots and the like from fine fabrics such as dry-clean only clothes. The method comprises dampening the fabric adjacent the water spot, then ironing the fabric on the side opposite of the side that received the water spot. Preferably, this method is performed in conjunction with a pre-treatment method, a non-immersion fabric treatment method, or both.

BACKGROUND OF THE INVENTION

It is well known that certain liquids, for example, coffee, milk and juice products, can stain fabrics. When a liquid contacts a fabric a residue is often deposited on the fibers of the fabric. This residue remains after the liquid evaporates from the fabric causing the stain. Clear liquids, such as water, do not typically deposit a residue on fabrics and thus, do not stain the fabric. But certain fabrics such as rayon, silk, acetate and wool, can be sensitive to clear liquids, which when deposited on these "fine" fabrics can cause a ring, or water spot, to form. Water spots often appear as stains, but in fact the individual fibers of the fabric are not stained, rather they are in a localized deformed state causing the material to appear different than the surrounding fabric.

In some cases, especially where a garment has never been exposed to immersion cleaning either with an aqueous or non-aqueous bath, fugitive, unfixed dyes may migrate during spot stain cleaning. The migration of fugitive dyes can result in a "corona" at the outer rim of the water spot, where fugitive dyes collect as the liquid ring expansion stops. Consequently, removal of this corona of fugitive dyes as well as the water spot itself is necessary to obtain a satisfactory appearance for the garment.

Stains can be removed by washing the residue, or foreign material, from the fibers, but removing water spots from fabrics is difficult. The removal of water spots often requires that the fabric fibers themselves be treated. While it would seem apparent that water spots might simply be removed by immersing the entire garment in an aqueous bath to effect uniformity, this may not be appropriate for garments labeled dry-clean only. Such immersion could, in fact, lead to irreversible adverse affects such as shrinking, stretching, or dye loss. Consequently, a technique which does not employ immersion in an aqueous bath to remove water spots is particularly desirable. Therefore, there exists a continuing need for methods, and products, for treating fabric articles to remove water spots therefrom.

SUMMARY OF THE INVENTION

The present invention provides a non-immersion cleaning/refreshment method for treating a fabric article, wherein the fabric article has a first and second side with at least one water spot on the first side. The method comprises the steps of:

a) placing the fabric article together with an absorbent carrier substrate having a liquid cleaning/refreshment composition releasably absorbed in the substrate in a containment bag;

b) placing the bag in a hot air clothes dryer, or the like apparatus, and operating the apparatus with heat and tumbling;

c) removing the fabric article from the bag;

d) placing a clean cloth on a hard flat surface;

e) placing the fabric article on the clean cloth such that the first side of the fabric article contacts the clean cloth;

f) dampening the fabric article adjacent the water spot with an aqueous solution; and g) ironing the second side of the fabric article adjacent the water spot with a clothes iron.

Water spots can be eliminated from fabric articles by the removal methods of this invention before or after the non-immersion cleaning method. Preferably the hard flat surface is a conventional ironing board and the clean cloth is a towel or conventional ironing board cover. It is also preferred that steps f) and g) be repeated as often as necessary to remove the water spot.

A kit comprising the necessary items for performing the non-immersion fabric treatment method and water spot removal method of this invention is also provided.

Water spots are especially noticeable on "fine" fabrics such as silk, acetate, rayon, wool, linen and the like. And water spots are especially difficult to remove from fine fabrics by conventional methods because fine fabrics typically require special handling such as dry-cleaning with non-aqueous solvents. Hence, the method of the present invention is tailored to removing water spots from fine fabrics, although this method can be used on virtually any natural or manmade fabric.

The present invention, in all of its embodiments, provides a solution to a persistent problem in the care and laundering of fine fabrics. That is, the removal of unsightly water spots from fine fabrics, which can now be accomplished by a convenient and relatively quick method. Moreover, the present method of ironing a fabric article on the side opposite the water spot provides superior and unexpected water spot removal when compared to a conventional ironing process.

DETAILED DESCRIPTION

When a liquid contacts a fabric article a "mark" is often deposited on the surface of the fabric. The "mark" often consists of a "stain" and a "water spot". The "stain" portion of the mark typically consists of material that was deposited on the fabric by the liquid. For example, when juice products are spilled on a shirt, the juice is absorbed into, or deposited onto the fibers of the fabric. When the liquid portion of the juice evaporates off of the fabric, a residue, or "stain", remains on the fibers. There are methods known to the art for removing various stains from fabrics. Certain preferred methods for removing stains from fabrics, by pre-treating the localized stained area of the fabric, are disclosed herein. But the products and methods of the present invention deal primarily with removing the second part of the mark on the fabric, that is, the "water spot".

While not wanting to be bound by any one theory, it is believed that "water spots" are caused when a liquid, such as water or other aqueous solutions, contacts a fabric causing the fibers in the fabric to absorb the liquid, which in turn causes the individual fibers to swell. When the liquid evaporates out of the fibers and off of the fabric, the fibers do not fully return to their original size and shape. The swollen fibers then appear visually different as compared to the surrounding fibers. Essentially, this different appearance is due to a change in reflectance of the affected area as compared to the surrounding area. Likewise, fugitive or excess dye can be dislocated by a localized water deposit causing the formation of a "corona", or a ring of displaced fabric dye. Hence, as used herein, a "water spot" comprises a localized malformation of the fibers of a fabric and coronas of fugitive dye. As can be appreciated, clear liquids, such as water, that do not stain fabrics, can cause water spots to form on fabric articles. Likewise, even the pre-treating methods described herein, which remove stains from fabrics, can leave behind an undesirable water spot on the fabric after the stain has been lifted.

OVERALL METHOD

The present invention provides a method for removing a water spot from a fabric article. This method is preferably conducted in conjunction with a non-immersion fabric cleaning method. The fabric article has a first side and a second side and the water spot is on the first side. The method comprises the steps of:

a) placing a clean cloth on a hard flat surface;

b) placing the fabric article on the clean cloth such that the first side of the fabric article contacts the clean cloth;

c) dampening the fabric article adjacent the water spot with an aqueous solution; and d) ironing the second side of the fabric article adjacent the water spot with a clothes iron.

It is also preferred that steps c) and d) be repeated as often as necessary to remove the water spot.

Preferably the hard flat surface is a conventional ironing board and the clean cloth is an adsorbent, light colored towel or conventional ironing board cover. By "light colored" it is meant that the towel has a minimal amount of colored dye, such that there is no visible transfer of dye from the towel to the fabric article during the ironing process. The hard flat surface can be any convenient surface that is firm and flat. For example, travelers often use the mattress of the bed in their hotel room as an ironing surface. Conventional clothes irons, ironing boards, and ironing board covers can be purchased at any of a variety of local department stores, hardware stores, K-Mart® stores, Wal-Mart® stores and the like. Conventional clothes irons typically have temperature settings for different fabric types, for example, a silk garment should be ironed at a lower temperature setting than a wool garment. It is understood that when practicing the method of this invention, the iron should be set at the manufacturers suggested temperature setting for the type of fabric being ironed.

The method defined above is preferably performed in conjunction with, that is, before or after, a pre-treating operation, a non-immersion fabric article laundering method or both.

A preferred pre-treating procedure for removing stains from a stained area of fabrics, comprises applying a pre-treating composition to the stained areas. In a preferred mode, in the pre-treating step of the method herein the pre-treating composition is applied to the fabric by any convenient means, e.g., by spraying, daubing, pouring, and the like. In an alternate mode, the pre-treating method can be conducted by contacting the stained area with the carrier sheet which is saturated with the pre-treating composition. Conveniently, the fabric and carrier sheet can be positioned in a holding tray or other suitable receptacle as a containment system for the cleaning composition.

In more detail, the pre-treating operation and non-immersion clothes laundering method herein can be conducted in the following manner. As discussed above, the method for removing water spots can be performed at virtually any point in this combined method. But water spots are often caused by the pre-treating method, hence, it is preferable to perform the water spot removal method after the pre-treating operation. As can be appreciated, modifications of the method can be practiced without departing from the spirit and scope of the present invention. The pre-treating operation comprises the following steps:

1. Place the stained area of the fabric over and in contact with a FAM or TBAL stain receiver as described below or, less preferably, an ordinary folded paper towel (e.g., preferably white or non-printed—to avoid dye transfer from the towel—BOUNTY® brand) on any suitable surface such as a table top, in a tray, etc.

2. Apply enough pre-treating composition from a dispenser bottle with a narrow spout which directs the composition onto the stain (without unnecessarily saturating the surrounding area of the fabric) to saturate the localized stained area—about 10 drops; more may be used for a larger stain.

3. Optionally, let the composition penetrate the stain for 3–5 minutes. (This is a pre-treat or pre-hydration step for better cleaning results.)

4. Optionally, apply additional composition—about 10 drops; more may be used for larger stains.

5. Optionally, use the tip on the dispenser bottle to work the stain completely out. Contact can be maintained for a period of 1–60 seconds for lighter stains and 1–5 minutes, or longer, for heavier or more persistent stains.

6. Optionally, blot the fabric, e.g., between paper towels, to remove excess composition. Or, the treated area can be blotted with a dampened sponge or other absorbent medium to flush the fibers and remove excess composition.

7. Conduct the in-dryer cleaning/refreshment method disclosed herein on the entire fabric using the article herein in the vapor-venting bag.

8. Following Step 7, it is preferred to promptly hang the slightly moist fabrics to avoid re-wrinkling and to complete the drying.

By "cleaning" herein is meant the removal of soils and stains from fabrics. ("Pre-treating" is the localized cleaning on areas of stain prior to the cleaning/refreshment step which is conducted in the venting bag.) By "refreshment" herein is meant the removal of malodors and/or wrinkles from the overall fabrics, or the improvement of their overall appearance, other than primarily removing soils and stains, although some soil and stain removal can occur concurrently with refreshment. Typical fabric cleaning refreshment/compositions herein can comprise more water (95– 99.9%, preferably greater than 95% up to about 99%) and fewer cleaning ingredients than conventional cleaning or pre-treating compositions.

A non-immersion method for treating, that is, cleaning/refreshing, an entire area of a fabric article, which optionally comprises a pre-treating operation described above, comprises the steps of:

(i) optionally, conducting a stain removal method according to the above disclosure on localized stained areas of the fabric article;

(ii) placing the fabric article together with a carrier substrate that releasably contains an aqueous fabric cleaning/refreshment composition in a vapor-venting containment bag;

(iii) placing the bag in a device to provide agitation, e.g., such as in a hot air clothes dryer and operating the dryer with heat and tumbling to moisten the fabric article and provide vapor venting; and (iv) removing the fabric article from the bag.

Again, the fabric articles are promptly hung to complete drying and/or to prevent re-wrinkling. While the method above is exemplified with only one fabric article, it is understood that a plurality of fabric articles can be treated simultaneously, in one containment bag, using the method defined above.

The cleaning/refreshment step of the overall method is conveniently conducted in a tumbling apparatus, preferably in the presence of heat. The nylon or other heat-resistant vapor-venting bag with the article herein plus aqueous cleaning/refreshment composition and containing the optionally pre-treated fabric being cleaned and refreshed is closed and placed in the drum of an automatic hot air clothes dryer at temperatures of 40° C. –150° C. The drum is allowed to revolve, which imparts a tumbling action to the bag and agitation of its contents concurrently with the tumbling. By virtue of this agitation, the fabrics come in contact with the carrier substrate containing the composition. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user. During the step, greater than about 40%, typically 40% to about 80%, of the moisture is vented from the bag.

Wrinkle-removing is another benefit derived by the non-immersion fabric treatment method defined above. With respect to this function of the method and compositions herein, it will be appreciated that wrinkling can be affected by the type of fabric, the fabric weave, fabric finishes, and the like. For fabrics which tend to wrinkle, it is preferred not to overload the vapor-venting bag used herein. Thus, for a bag with, for example, an operational capacity of up to about 5 kg of fabrics, it may be best to process up to only about 60% of capacity, (i.e., up to about 3 kg) of fabrics to further minimize wrinkling.

Carrier Substrate—When used in the in-dryer step of the present method, the cleaning and/or refreshment compositions are used in combination with an absorbent carrier substrate, or "carrier". The carrier releasably contains the compositions. By "releasably contains" means that the compositions are effectively released from the carrier onto the soiled fabrics as part of the non-immersion cleaning and/or fabric refreshment methods herein. This release occurs mainly by volatilization of the composition from the carrier substrate through the vapor-permeable coversheet, or by a combination of vapor and liquid transfer, although bulk liquid transfer can be minimized by means of an optional coversheet. By way of definition, a "carrier sheet" can be a carrier substrate alone, or a carrier substrate that has been encompassed by a coversheet.

The carrier can be in any desired form, such as powders, flakes, shreds, and the like. However, it is highly preferred that the carrier be in the form of an integral pad or sheet which substantially maintains its structural integrity throughout the process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present method. The carriers must not be flammable during the process, nor should they deleteriously interact with the cleaning or refreshment composition or with the fabrics being cleaned. In general, non-woven polyester-based pads or sheets are quite suitable for use as the carrier herein.

The carrier used herein is most preferably non-linting. By "non-linting" herein is meant a carrier which resists the shedding of visible fibers or microfibers onto the fabrics being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-linting qualities of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers.

The size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a generally rectangular carrier may have the dimensions (X-direction) of from about 20 cm to about 35 cm, and (Y-direction) of from about 18 cm to about 45 cm.

The carrier is intended to contain a sufficient amount of the cleaning/refreshment compositions to be effective for their intended purpose. The capacity of the carrier for such compositions will vary according to the intended usage. For example, pads or sheets which are intended for a single use will require less capacity than such pads or sheets which are intended for multiple uses. For a given type of carrier the capacity for the cleaning or refreshment composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning or refreshment composition is effectively provided by means of the carrier.

A preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference. Preferred materials for use herein have the following physical properties.

HYDRASPUN ®, Grade 10244

| | Units of Measure | Targets | Optional Range |
|---|---|---|---|
| Basis Weight | $gm/m^2$ | 55 | 35–75 |
| Thickness | microns | 355 | 100–1500 |

-continued

| HYDRASPUN ®, Grade 10244 | | | |
|---|---|---|---|
| | Units of Measure | Targets | Optional Range |
| Density | gm/cc | 0.155 | 0.1–0.25 |
| Dry Tensile | gm/25 mm | | |
| MD | | 1700 | 400–500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | $gm/cm^2$ | 1050 | 700–1200 |

*MD—machine direction; CD—cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning/refreshment compositions herein, but actually helps optimize cleaning performance. While not intending to be limited by theory, it may be speculated that this carrier is more effective in delivering the compositions to soiled fabrics, perhaps due to its mixture of fibers. Whatever the reason, improved cleaning performance is secured.

It has also been discovered that this hydroentangled carrier material provides an additional, unexpected benefit due to its resiliency. In-use, the articles herein are designed to function in a substantially open configuration. However, the articles may be packaged and sold to the consumer as sheets which are in a folded configuration. It has been discovered that the carrier sheets made from conventional materials tend to undesirably revert to their folded configuration in-use. Indeed, this tendency to re-fold along the original fold lines seems to be exacerbated by using a coversheet. While the hydroentangled materials used to form the carrier sheet herein have less tendency to re-fold during use than do other carrier materials, it has been determined experimentally that up to 60% refold does seem to occur under intended usage conditions when a coversheet is present. In some instances, and especially with certain types of fabrics, this can be problematic, inasmuch as wet strikes can occur along the sharp fold lines, presumably due to pressure forcing the liquid composition through the fibrous coversheet.

However, it has now been determined that by providing holes or otherwise fenestrating the carrier sheet, this tendency to re-fold is substantially lessened even when the coversheet is used in the manner of the present invention. Thus, in a preferred mode of practicing the present invention a plurality of holes, slits, or other fenestrations are placed in the carrier sheet to help minimize re-fold when the article is used. The number and placement of the holes or fenestrations can be determined by routine experimentation. Example I hereinafter gives the size and number of circular holes which are useful for an article of the size and with the load of cleaning/refreshment composition described therein.

Compositions—The user of the present method can be provided with various compositions to use in the optional pre-treating procedure and on the carrier substrate of the invention. One problem associated with known fabric treatment compositions is their tendency to leave visible residues on fabric surfaces. Such residues are problematic and are preferably to be avoided herein since the present method does not involve conventional immersion or rinse steps. Accordingly, the compositions used herein should, most preferably, be substantially free of various polyacrylate-based emulsifiers, polymeric anti-static agents, inorganic builder salts and other residue-forming materials, except at low levels of about 0.1%–0.3%, and preferably 0%, of the final compositions. Water used in the compositions should preferably be distilled, deionized or otherwise rendered free of residue-forming materials. Stated otherwise the compositions herein should be formulated so as to leave substantially no visible residue on fabrics being treated according to the practice of this invention.

Accordingly, in a preferred aspect of this invention there are provided cleaning/refreshment compositions which are substantially free of materials which leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred pre-treating composition will also contain a cleaning solvent such as butoxy propoxy propanol (BPP) at a low, but effective, level, typically about 1% to about 4%, preferably about 2%. Advantageously, when thus formulated such compositions exist as phase-stable aqueous solutions rather than as suspensions or emulsions. Thus, such compositions do not require use of additional emulsifiers, thickening agents, suspending agents, gelling agents, and the like, all of which can contribute to the formation of undesirable visible residues on the fabric.

Indeed, as an overall proposition, any of the chemical compositions which are used to provide the pre-treating and the overall cleaning and/or refreshment functions herein comprise ingredients which are safe and effective for their intended use, and, as noted above, preferably do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, acetate, rayon, rayon acetate, and the like. In addition, the compositions herein comprise ingredients which are specially selected and formulated to minimize dye removal or migration from the stain site of fugitive, unfixed dye from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

The dye removal attributes of the present compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner/refresher compositions using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) "I see a lot of dye on the towel"; through (4) "I know I see quite a lot of dye on the towel" are assigned by panelists.

In addition to the foregoing considerations, the compositions used herein are preferably formulated such that they are easily dispensed and not so adhesive in nature that they render pre-treating unhandy. However, and while not intending to be limiting of the present invention, the preferred compositions disclosed herein afford a pre-treating process which is both effective and aesthetically pleasing.

Aqueous Pre-Treating Compositions (a) Bleach—The compositions herein may optionally comprise from about 0% to about 7%, by weight, of hydrogen peroxide. If used, preferred pre-treating compositions will comprise 0.5 to about 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Solvent—The compositions herein may comprise from about 0% to about 10%, by weight, of butoxy propoxy propanol (BPP) solvent. Preferred pre-treating compositions will comprise 1–4% BPP.

(c) Water—The preferred, low residue compositions herein may comprise from about 90%, preferably from about 95.5% to about 99%, by weight, of water.

(d) Surfactant—The compositions herein may optionally comprise from about 0.05% to about 2%, by weight, of surfactants, such as MgAES and $NH_4$AES, amine oxides, ethoxylated alcohols or alkyl phenols, alkyl sulfates, and mixtures thereof As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.3% $MgAE_1S$/0.03% $C_{12}$ dimethyl amine oxide. Another preferred composition comprises 4% BPP/0.4% AS.

(e) Optionals—The compositions herein may comprise minor amounts of various optional ingredients, including bleach stabilizers, perfumes, preservatives, and the like. If used, such optional ingredients will typically comprise from about 0.05% to about 2%, by weight, of the compositions, having due regard for residues on the cleaned fabrics.

(f) Chelator—Compositions which contain $H_2O_2$ will also typically contain a chelating agent. The chelating agent is selected from those which, themselves, are stable in aqueous $H_2O_2$ and which stabilize the $H_20_2$ by chelating vagrant metal ions. Such chelating agents are typically already present at low, peroxide-stabilizing amounts (0.01–1%) in commercial sources of hydrogen peroxide. A variety of phosphonate chelators are known in stabilizing $H_2O_2$. The amino phosphonates are especially useful for this purpose. Various amino phosphonates are available as under the DEQUEST® trade name from the Monsanto Company, St. Louis, Mo. Representative, but non-limiting, examples include ethylenediamine tetrakis (methylene phosphonic) acid, diethylenetriamine penta(methylene phosphonic) acid, and the water-soluble salts thereof Amino tris(methylene phosphonic) acid or its water-soluble salts (as DEQUEST 2000®) is a preferred chelator.

The pH range of the pre-treating compositions helps provide stability to the hydrogen peroxide and is typically in the acid-slightly basic range from about 3 to about 8, preferably about 6.

Organic Solvent—The preferred cleaning (especially including pre-treating) solvent herein is butoxy propoxy propanol (3PP) which is available in commercial quantities as a mixture of isomers in about equal amounts. The isomers, and mixtures thereof, are useful herein. The isomer structures are as follows:

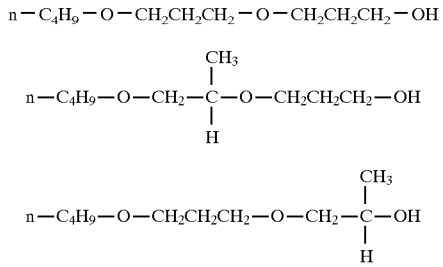

While the pre-treating compositions herein function quite well with only the BPP, water and surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein.

Surfactants—Nonionics such as the ethoxylated $C_{10}$–$C_{16}$ alcohols, e.g., NEODOL 23-6.5, can be used in the compositions. The alkyl sulfate surfactants which may be used herein as cleaners and to stabilize aqueous compositions are the $C_8$–$C_{18}$ primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$–$C_{16}$ alkyl, EO is —$CH_2CH_2$—O—, x is 1–10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$–$C_{16}$ alkyl dimethyl amine oxide surfactants can also be used. A preferred mixture comprises $MgAE_1S/C_{12}$ dimethyl amine oxide at a weight ratio of about 10:1. Other surfactants which improve phase stability and which optionally can be used herein include the polyhydroxy fatty acid amides, e.g., $C_{12}$–$C_{14}$ N-methyl glucamide. AS stabilized compositions preferably comprise 0.1%–0.5%, by weight, of the compositions herein. MgAES and amine oxides, if used, can comprise 0.01%–2%, by weight, of the compositions. The other surfactants can be used at similar levels.

Having due regard to the foregoing considerations, the following illustrates the various other ingredients which can be used in the liquid compositions herein, but is not intended to be limiting thereof. In general, the pre-treating compositions are formulated to be somewhat "stronger" in cleaning power than the cleaning/refreshment compositions, although this can be varied, according to the desires of the formulator.

Other Optionals—In addition to the water, the preferred BPP solvent, the optional $H_2O_2$ and the surfactants disclosed above, liquid compositions used herein may comprise various optional ingredients, such as perfumes, preservatives, brighteners, salts for viscosity control, pH adjusters or buffers, and the like. The following illustrates preferred ranges for cleaning compositions for use herein, but is not intended to be limiting thereof

| Ingredient | % (wt.) Formula Range |
|---|---|
| BPP (Solvent) | 0.05–5 |
| Surfactant | 0–2 |
| Perfume | 0.01–1.5 |
| Water | Balance |
| pH range from about 6 to about 8. | |

Other solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (APP), propoxy propoxy propanol (PPP), and all isomers and mixtures, respectively, of MPP, EPP, and BPP, as well as butoxy propanol (13P), and the like, and mixtures thereof If used, such solvents or co-solvents will typically comprise from about 0.5% to about 2.5%, by weight, of the aqueous compositions herein. Non-aqueous (less than 50% water) compositions which optionally can be used in the pre-treating step, can comprise the same solvents.

Preferred compositions for use in the in-dryer cleaning/refreshment step of the method herein are as follows.

| Ingredient | % (wt.) | Range (% wt.) |
|---|---|---|
| Water | 99.0 | 95.1–99.9 |
| Perfume | 0.5 | 0.05–1.5 |
| Surfactant* | 0 | Optional to 2% |
| Ethanol or Isopropanol | 0 | Optional to 4% |
| Solvent (e.g. BPP) | 0 | Optional to 4% |

*Especially ethoxylated alcohols, as disclosed herein. The fabric refreshment compositions may also contain anionic surfactants. Such anionic surfactants are well-known in the detergency arts. Commercial surfactants available as TWEEN ®, SPAN ®, AEROSOL OT ® and various sulfosuccinic esters are especially useful herein.

In addition, a variety of cleaning compositions disclosed in the patent literature, e.g. those cited above—WO 97/00993A1; WO 97/00990A2; GB 2,302,553A; GB 2,302,878A; and GB 2,302,879A can be used in the articles herein.

Perfume—It has been determined that higher molecular weight, high boiling point, malodorous chemicals tend to be retained on the fabrics, at least to some degree. These malodors can be overcome, or "masked", by perfumes. Accordingly, it will be appreciated that the perfumer should select at least some perfume chemicals which are sufficiently high boiling that they are not entirely lost during the process. A wide variety of aldehydes, ketones, esters, acetals, and the like, perfumery chemicals which have boiling points above about 50° C., preferably above about 85° C., are known. Such ingredients can be delivered to the fabrics being treated by means of the carrier substrate herein during the methods herein, thereby helping to reduce the user's perception of malodors. Non-limiting examples of perfume materials with relatively high boiling components include various essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol and mixed pine oil terpenes, linalool, linalyl acetate, geraniol, nerol, 2-(1,1-dimethylethyl)-cyclohexanol acetate, orange terpenes and eugenol. Of course, lower boiling materials can be included, with the understanding that some loss will occur due to venting.

Containment Bag—The compositions are loaded on the carrier substrate, which is placed in a bag environment along with the fabric articles to be cleaned and refreshed, for use in a heated operating clothes dryer, or the like, to remove malodors from fabrics as a dry cleaning alternative or "fabric refreshment" method. The warm, humid environment created inside this bag volatilizes malodor components in the manner of a "steam distillation" process, and moistens fabrics and the soils thereon. This moistening of fabrics can loosen pre-set wrinkles, but it has now been discovered that overly wet fabrics can experience setting of new wrinkles during the drying stage toward the end of the dryer cycle. Proper selection of the amount of water used in the method and, importantly, proper venting of the bag in the present manner can minimize wrinkling. Moreover, if the bag is not vented, the volatilized malodorous materials removed from the fabrics can undesirably be re-deposited thereon.

Thus, in accordance with art-disclosed methods, the method herein can be conducted in a sealed bag. However, in a highly preferred mode, the method of the present invention preferably employs a vapor-venting containment bag. The bag is preferably designed for multiple uses and reuses, and is especially adapted for use by the consumer in any conventional hot air clothes dryer apparatus, such as those found in the home or in commercial laundry/cleaning establishments. The bag is designed to vent water and other vapors (including malodorous materials) which emanate from within the bag when used in the manner described herein. The vapors released from the bag are thence exhausted through the air vent of the dryer apparatus.

As described more fully hereinafter, the preferred venting bag is provided with a vapor-venting closure which provides one or more gaps through which vapors are released from the bag, in-use. In a preferred embodiment, the size of this gap is selected to provide controlled vapor release from the bag under the indicated operating conditions. While other gap sizes and operating conditions can be used, a preferred balance between vapor containment within the bag to perform the cleaning/refreshment function and vapor release from the bag has now been determined. For a full description of vapor venting bags for use herein, see co-pending U.S. Patent application Ser. No. 08/785,440, the entire disclosure of which is incorporated herein by reference.

Alternatively, the bag can be provided with a series of holes or other fenestrations which provide vapor venting. However, such venting is not as effective as the vapor-venting closure.

In one mode, the present invention employs a vapor-venting containment bag comprising an open end, a closed end and flexible side walls having inner and outer surfaces, the open end of said bag having a section of one side wall extending beyond said open end to provide a flexible flap, said flap having first fastening device affixed thereto, said flap being foldable to extend over a portion of the outside surface of the opposing side wall, said flap being affixable to the outer surface of the opposing wall of the bag by engaging said first fastening device on the inside face of the flap with a second fastening device present on the outside face of said opposing side wall, said first and second fastening devices, when thus engaged, forming a fastener, thereby providing a closure for the open end of the bag. Said first and second fastening devices are disposed so as, when engaged, to provide vapor-venting along said closure, especially at the lateral edges of the closure. The bag herein is most preferably formed from film which is heat resistant up to at least about 204° C.–260° C. Nylon is a preferred film material for forming the bag. In another embodiment, the edge of one wall of the bag is notched along a substantial portion of its width to facilitate and optimize vapor venting.

In an alternate mode, the flap can be folded to provide the closure, tucked inside the opposing side wall, and secured there by a fastener. In this mode, vapors are vented along the closure and especially at the lateral edges of the closure. In yet another mode, the side walls are of the same size and no flap is provided. Fastening devices placed intermittently along portions of the inner surfaces of the side walls are engaged when the lips of the side walls are pressed together to provide closure. One or more vapor-venting gaps are formed in those regions of the closure where no fastening device is present.

While the fastening devices herein can comprise chemical adhesives, the bag is preferably designed for multiple uses. Accordingly, reusable mechanical fasteners are preferred for use herein. Any reusable mechanical fastener or fastening means can be used, as long as the elements of the fastener can be arranged so that, when the bag is closed and the fastener is engaged, a vapor-venting closure is provided. Non-limiting examples include: bags wherein said first and second fastening devices, together, comprise a hook and loop (VELCRO®-type) fastener; hook fasteners such as described in U.S. Pat. No. 5,058,247 to Thomas & Blaney issued Oct. 22, 1991; bags wherein said first and second fastening devices, together, comprise a hook and string type fastener; bags wherein said first and second fastener devices, together, comprise an adhesive fastener; bags wherein said first and second fastening devices, together, comprise a toggle-type fastener; bags wherein said first and second fastening devices, together, form a snap-type fastener; as well as hook and eye fasteners, ZIP LOK®-style fasteners, zipper-type fasteners, and the like, so long as the fasteners are situated so that vapor venting is achieved. Other fasteners can be employed, so long as the vapor-venting is maintained when the bag is closed, and the fastener is sufficiently robust that the flap does not open as the bag and its contents are being tumbled in the clothes dryer. The fastening devices can be situated that the multiple vapor-venting gaps are formed along the closure, or at the lateral edges, or so that the gap is offset to one end of the closure. In yet another embodiment, both ends of the bag are provided with a vapor venting closure.

Preferred bags of the foregoing type which are designed for use in a conventional U.S.-style automatic, in-home hot air clothes dryer will have a volume in the range from about 10,000 $cm^3$ to about 25,000 $cm^3$.

The invention also employs a method for cleaning or refreshing fabrics by contacting said fabrics with a fabric cleaning/refreshing composition comprising water in the aforesaid vapor-venting containment bag. This method is conveniently carried out in a hot air clothes dryer, or the like, at a dryer operating temperature from about 40° C. to about 150° C., whereby malodors present on said fabrics are vented from the bag by means of the vapor-venting closure.

The design of the venting ability of the bag achieves a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors.

The bag is designed with sufficient venting to trap a portion of water vapors (especially early in the dryer cycle) but to allow most of the water to escape by the end of the cycle. Said another way, the rate of vapor release is, preferably, optimized to secure a balance of vapor venting and vapor trapping. A preferred bag design employs a water vapor impermeable film such as nylon, with a the closure flap (preferably with a hook-and-loop VELCRO®-type fastener) like that of a large envelope. The degree of slack in the fold-over portion of the closure flap can be varied to provide a vapor-venting air gap or partial opening which controls the rate of vapor venting from of the bag. In another mode, a notch is cut along the edge of the side wall opposite the flap to further adjust the venting. The fastener devices run only partly along the closure, thereby allowing venting to also occur at the lateral edges of the closure.

The following is intended to assist the formulator in the manufacture and use of vapor-venting bags in the manner of this invention, but is not intended to be limiting thereof.

The construction of the preferred, heat-resistant vapor-venting bag used herein to contain the fabrics in a hot air laundry dryer or similar device preferably employs thermal resistant films to provide the needed temperature resistance to internal self-sealing and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the fastener is also constructed of a thermal resistant material. Sealing can be done using standard impulse heating equipment. In an alternate mode, a sheet of nylon is simply folded in half and sealed along two of its edges. In yet another mode, bags can be made by air blowing operations. The method of assembling the bags can be varied, depending on the equipment available to the manufacturer and is not critical to the practice of the invention.

The dimensions of the containment bag can vary, depending on the intended end-use. For example, a relatively smaller bag can be provided which is sufficient to contain one or two silk blouses. Alternatively, a larger bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 0.2–5 kg) without being so large as to block dryer vents in most U.S.-style home dryers. Somewhat smaller bags may be used in relatively smaller European and Japanese dryers.

The bag herein is preferably flexible, yet is preferably durable enough to withstand multiple uses. The bag also preferably has sufficient stiffness that it can billow, in-use, thereby allowing its contents to tumble freely within the bag during use. Typically, such bags are prepared from 0.025 mm to 0.076 mm (1–3 mil) thickness polymer sheets. If more rigidity in the bag is desired, somewhat thicker sheets can be used.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C.). Under circumstances where excessive heating is not of concern, the bag can be made of polyester, polypropylene or any convenient polymer material.

Vapor Venting Evaluation—In its broadest sense, the preferred vapor-venting containment bag used herein is designed to be able to vent at least about 40%, preferably at least about 60%, up to about 90%, preferably no more than about 80%, by weight, of the total moisture introduced into the bag within the operating cycle of the clothes dryer or other hot air apparatus used in the method herein. (Of course most, if not all, of organic cleaning solvents, if any, will also be vented during together with the water. However, since water comprises by far the major portion of the cleaning/refreshment compositions herein, it is more convenient to measure and report the venting as water vapor venting.)

It will be appreciated by those knowledgeable about the operation of hot air clothes dryers and similar apparatus that the rate of venting will usually not be constant over the entire operating cycle. All dryers have a warm-up period at the beginning of the operating cycle, and this can vary according to the specifications of the manufacturer. Most dryers have a cool-down period at the end of the operating cycle. Some venting from the containment bag can occur during these warm-up and cool-down periods, but its rate is generally less than the venting rate over the main period of the drying cycle. Moreover, even during the main period of the cycle, many modern dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved.

Moreover, the user of the present containment bag may choose to stop the operation of the drying apparatus before the cycle has been completed. Some users may wish to secure fabrics which are still slightly damp so that they can be readily ironed, hung up to dry, or subjected to other finishing operations.

Apart from the time period employed, the Vapor-Venting Equilibrium ("VVE") for any given type of vapor-venting closure will depend mainly on the temperature achieved within the dryer—which, as noted above, is typically reported as an average "dryer air temperature". In point of fact, the temperature reached within the containment bag is more significant in this respect, but can be difficult to measure with accuracy. Since the heat transmittal through the walls of the bag is rather efficient due to the thinness of the walls and the tumbling action afforded by conventional clothes dryers, it is a reasonable approximation to measure the VVE with reference to the average dryer air temperature.

Moreover, it will be appreciated that the vapor-venting from the containment bag should not be so rapid that the aqueous cleaning/refreshment composition does not have the opportunity to moisten the fabrics being treated and to mobilize and remove the soils/malodors therefrom. However, this is not of practical concern herein, inasmuch as the delivery of the composition from its carrier substrate onto the fabrics afforded by the tumbling action of the apparatus occurs at such a rate that premature loss of the composition by premature vaporization and venting is not a significant factor. Indeed, the preferred bag herein is designed to prevent such premature venting, thereby allowing the liquid and vapors of the cleaning/refreshment composition to remain within the bag for a period which is sufficiently long to perform its intended functions on the fabrics being treated.

The following Vapor-Venting Evaluation Test (WET) illustrates the foregoing points in more detail. Larger or smaller containment bags can be used, depending on the volume of the dryer drum, the size of the fabric load, and the like. As noted above, however, in each instance the containment bag is designed to achieve a degree of venting, or VVE "score", of at least about 40% (40 VVE), preferably at least about 60% (60 VVE), up to about 90% (90 VVE).

VAPOR-VENTING EVALUATION TEST

Materials:

Envelope or "Standard", i.e., Control Containment Bag to be evaluated for VVE.

Carrier Substrate (15"×11"; 38.1 cm×27.9 cm) HYDRASPUN® carrier substrate sheet from Dexter with (10444) or without (10244) Binder Wool Blouse: RN77390, Style 12288, Weight approx. 224 grams Silk Blouse: RN40787, Style 0161, Weight approx. 81 grams Rayon Swatch: 45"×17"(114.3 cm×43.2 cm), Weight approx. 60 grams Pouch: 5"×6.375"(12.7 cm×16.2 cm) to contain the Carrier Substrate and water De-ionized Water; Weight is variable to establish VVE.

Pretreatment of Fabrics:

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure:

1. Water of various measured weights from 0 to about 40 grams is applied to the carrier substrate a minimum of 30 minutes before running a vented bag test. The substrate is folded, placed in a pouch and sealed.
2. Each fabric is weighed separately and the dry weights are recorded. Weights are also recorded for the dry carrier substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the carrier substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the carrier substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

It can be seen from examining a series of VVET results at various initial moisture levels that the water at lower initial levels is being disproportionately captured by the garment load, the headspace, and the nylon bag, such that venting of water and volatile malodors begins in earnest only after the VVE value is achieved. Since this occurs only when about 15–20 grams or more of water is initially charged, it is seen that a VVE of greater than about 40 is needed to avoid excessive wetting of garments, leading to unacceptable wet-setting of wrinkles, as discussed herein.

Stain Receiver—A stain receiver can optionally be used in the optional pre-treating operation herein. Such stain receiver can be any absorbent material which imbibes the liquid composition used in the pre-treating operation. Disposable paper towels, cloth towels such as BOUNTY® brand towels, clean rags, etc., can be used. However, in a preferred mode the stain receiver is designed specifically to "wick" or "draw" the liquid compositions away from the stained area. One preferred type of receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils (1.524 mm) thick. It optionally, but preferably, has a barrier film on its rear surface to prevent the cleaning liquid from passing onto the surface on which the pre-treating operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer.

More particularly, the absorbent stain receiver article herein can be conveniently manufactured using procedures known in the art for manufacturing nonwoven, thermally bonded air laid structures ("TBAL"). As an overall proposition, TBAL manufacturing processes typically comprise laying-down a web of absorbent fibers, such as relatively short (4–5 mm) wood pulp fibers, in which are commingled relatively long (30–50 mm) bi-component fibers which melt slightly with the application of heat to achieve thermal bonding. The bi-component fibers intermingled throughout the wood pulp fibers thereby act to "glue" the entire mat together. Different from conventional TBAL-type structures, the disposition of the bi-component fibers in the upper and lower layers of the stain receiver herein is not uniform. Rather, the upper (fluid receiving) layer of the fibers which comprises the stain receiver is relatively richer in bi-component fibers than in wood pulp (or other cellulosic) fibers. Since the bi-component fibers are made from synthetic polymers which are relatively hydrophobic, the upper layer of fibers in the stain receiver tends to be more hydrophobic, as compared with the lower layer of fibers which, since it contains a high proportion of wood pulp, tends to be more hydrophilic. This difference in hydrophobicity/hydrophilicity between the upper and lower fiber layers in the stain receiver helps draw water (e.g., the aqueous compositions herein) and stain materials out of the fabrics which are being treated in the manner disclosed herein.

To illustrate the foregoing in more detail, in one mode, the present stain receiver the uppermost (fluid receiving) layer (to be placed against the soiled garment) is about 50% bicomponent fiber and about 50% wood pulp, by weight, with a basis weight of about 50 grams/$m^2$ (gsm). The lower layer is an 80/20 (wt.) blend of wood pulp and bicomponent staple fiber with a basis weight of about 150 gsm. These ratios can be varied, as long as the upper layer is more hydrophobic than the lower layer. For example, upper layers of 60/40, 70/30, etc. bicomponent/wood can be used. Lower layers of 90/10, 65/35, 70/30, etc. wood/bicomponent can be used.

Lint Control Binder Spray—A heat crosslinkable latex binder can optionally be sprayed onto the upper layer of the stain receiver article to help control lint and to increase strength. A variety of alternative resins may be used for this purpose. Thus, the surface of the uppermost layer can be sprayed with a crosslinkable latex binder (Airflex 124, supplied by Air Products) at a concentration of about 3 to 6 grams per square meter. This binder does not have great affinity for water relative to wood pulp, and thus does not importantly affect the relative hydrophobicity of the upper layer. Cold or hot crimping, sonic bonding, heat bonding and/or stitching may also be used along all edges of the receiver to further reduce linting tendency.

Backing Sheet—When thus prepared, the bi-layer absorbent structure which comprises the stain receiver is sufficiently robust that it can be used as-is. However, in order to prevent strike-through of the liquid onto the table top or other treatment surface selected by the user, it is preferred to affix a fluid-impermeable barrier sheet to the bottom-most surface of the lower layer. This backing sheet also improves the integrity of the overall stain receiver article. The bottom-most surface of the lower layer can be extrusion coated with an 0.5–2.0 mil (0.013 mm–0.05 mm), preferably 0.75 mil (0.019 mm), layer of PE or PP film using conventional procedures. The film layer is designed to be a pinhole-free barrier to prevent any undesired leakage of the liquid composition beyond the receiver. This backing sheet can be printed with usage instructions, embossed and/or decorated, according to the desires of the formulator. The stain receiver is intended for use outside the dryer. However, since the receiver may inadvertently be placed in the dryer and subjected to high temperatures, it is preferred that the backing sheet be made of a heat resistant film such as polypropylene or nylon.

Basis weight—This can vary depending on the amount of cleaning/refreshment solution provided/anticipated to be absorbed. The preferred stain receiver structure exhibits a horizontal absorbency of about 4–15 grams of water for every gram of nonwoven. A typical 90 mm×140 mm receiver absorbs about 10–20 grams of water. Since very little fluid is used in the typical stain removal process, much less capacity is actually required. A practical basis weight range is therefore about 10 g. to about 50 g.

Size—The size of the preferred receiver is about 90 mm by 140 mm, but other sizes can be used. The shape can be varied.

Fibers—Conveniently available 2–3 denier (0.0075–0.021 mm) polyethylene/polypropylene PE/PP bicomponent staple and standard wood pulp (hammermilled) fibers are used in constructing the preferred receiver. Other common staple fibers such as polyester, acrylic, nylon, and bicomponents of these can be employed as the synthetic component. Again, capillary suction requirements need to be considered when selecting these fibers and their sizes or deniers. Larger denier detracts from capillary suction as does surface hydrophobicity. The absorbent wood pulp fiber can also be substituted with cotton, hemp, rayon, and others. If desired, the lower layer can also comprise the so-called "supersorber" absorbent gelling materials (AGM)

which are known for use in the diaper and catamenial arts. Such AGMs can comprise 1% to 20%, by weight, of the lower layer.

Thickness—The overall thickness (measured unrestrained) of the stain receiver is about 60 mils (1.524 mm), but can be varied widely. The low end may be limited by the desire to provide absorbency impression. 25 mils to 200 mils (0.6 mm–5.1 mm) is a reasonable range.

Capillary suction/density—The overall density of the stain receiver affects both absorbency rate and fluid capacity. Typical wood pulp containing absorbent articles have a density (measured unrestrained) that ranges around 0.12–0.15 g/cc +/–0.05. The preferred bi-layer stain receiver herein also has a density in the same range, but can be adjusted outside this range. Higher density increases stiffness; lower density decreases overall strength and makes Tinting more probable. The capillary suction is determined by the type of fibers, the size of the fibers, and the density of the structure. Fabrics come in many varieties, and will exhibit a large range of capillary suction, themselves. It is desirable to construct a receiver that has a greater surface capillary suction than that of the stained garment being treated.

Colors—White is the preferred color, as it will best show stains as they are being removed from the fabrics being treated. However, there is no other functional limit to the color.

Embossing—The preferred stain receiver structure is embossable with any desired pattern or logo.

Optional Nonwoven (NW) types—While the TBAL stain receiver structure is preferred to permit density control, good thickness perception, good absorbency, and good resiliency, other types of NWs that can reasonably be used are hydroentangled, carded thermal, calendar-bonded, and other good wipe substrate-making processes (including thermal bonded wet-laid, and others).

Manufacture—The manufacture of the preferred bilayer stain receiver is conducted using conventional TBAL processes. In one mode, the lower wood fiber-rich layer is first laid-down and the upper, synthetic fiber-rich layer is laid-down on top of it. The optional binder spray is applied to the upper layer at any convenient time. The resulting bi-layer structure is collected in rolls (which compacts the overall structure somewhat). Overall, the bi-layer structure (unrestrained) has a thickness of about 60 mils and a density of about 0.13–0.15 g/cc. This density may vary slightly, depending on the usage rates of the binder spray. The optional backing sheet is applied by passing the structure in sheet form through nip-rollers, together with a sheet of the backing film. Again, conventional procedures are used. If desired, and as a cost savings, the relative thicknesses of the lower and upper layers can be varied. Thus, since wood pulp is less expensive than bi-component fibers, the manufacturer may decide to lay down a relatively thicker lower layer, and a relatively thinner upper layer. Thus, rather than a structure whose upper/lower layer thickness ratio is about 1:1, one can select ranges of 0.2:1, 0.3:1, 0.5:1, and the like. If more absorbency is required, the ratios can be reversed. Such considerations are within the discretion of the manufacturer.

The bi-layer stain receiver is intended to be made so inexpensively that it can be discarded after a single use. However, the structures are sufficiently robust that multiple re-uses are possible. In any event, the user should position the article such that "clean" areas are positioned under the stained areas of the fabric being treated in order to avoid release of old stains from the stain receiver back onto the fabric.

Another highly preferred type of stain receiver for use herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

For pre-treating, the stained area of the garment or fabric swatch is placed over a section of FAM, followed by treatment with an aqueous or non-aqueous cleaning solution. While pre-treating progresses, the suction effects of the FAM capillaries cause the cleaning solution and stain debris to be carried into the FAM, where the stain debris is largely retained. At the end of this step the stain as well as almost all of the cleaning solution is found to have been removed from the fabric being treated and transferred to the FAM. This leaves the fabric surface only damp, with a minimum residue of the cleaning solution/stain debris which can lead to undesirable rings on the fabrics.

The manufacture of FAM-type foams for use as the stain receiver herein forms no part of the present invention. The manufacture of FAM foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat. No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat. No. 5,352,711 to DesMarais, issued Oct. 4, 1994; PCT application 93/04115 published Mar. 4, 1993, and U.S. Pat. No. 5,292,777 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; U.S. Pat. No. 5,550,167 to DesMarais, issued Aug. 27, 1996.

The acquisition and absorbency of the FAM with respect to the liquid pre-treating compositions herein is superior to most other types of absorbent materials. For example, the FAM has a capacity of about 6 g ($H_2O$) per gram of foam at a suction pressure of 100 cm of water. By contrast, cellulose wood fiber structures have substantially no capacity above about 80 cm of water. Since, in the present method the volume of liquid pre-treater used is relatively low (a few milliliters is typical) the amount of FAM used can be small. This means that the pad of FAM which underlays the stained area of fabric can be quite thin and still be effective. However, if too thin, the pad may tend to crumble, in-use. (As noted above, a backing sheet can be applied to the FAM to help maintain its integrity.)

Stain receiver pads made of FAM foam can be used in either of two ways. In one mode, the uncompressed foam is used. Uncompressed FAM pads having a thickness in the range of about 0.3 mm to about 15 mm are useful. In another mode, the FAM foam can be used in a compressed state which swells as liquid pre-treater with its load of stain material is imbibed. Compressed FAM foams having thicknesses in the range of about 0.02 inches (0.5 mm) to about 0.135 inches (3.4 mm) are suitable herein.

The preparation of FAM foam (also sometimes referred to in the literature as "HIPE", i.e., high internal phase emulsion) is described in the patents cited hereinabove. The following illustrates the preparation of a compressed FAM foam for use herein having a thickness of about 0.025 inches (0.063 cm). Such compressed foams in the 0.025 in.–0.027 in. (0.063 cm–0.068 cm) range are especially useful as the stain receiver herein.

The following Examples further illustrate the invention, but are not intended to be limiting thereof

EXAMPLE I

A low residue liquid fabric cleaning/refreshment product for use in a vented dryer bag is prepared, as follows.

| Ingredient | % (wt.) |
|---|---|
| Emulsifier (TWEEN 20)* | 0.5 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

A 10 ¼ in.×14 ¼ in. (26 cm×36 cm) carrier sheet of HYDRASPUN® is prepared. The carrier sheet is covered on both sides with a topsheet and a bottomsheet of 8 mil (0.2 mm) Reemay fabric coversheet material. The coversheet (i.e., both topsheet and bottomsheet) are bonded to the carrier sheet by a Vertrod® or other standard heat sealer device, thereby bonding the laminate structure together around the entire periphery of the carrier sheet. The edges of the carrier sheet around its periphery are intercalated between the topsheet and bottomsheet by the bond.

The bonded laminate structure thus prepared is folded and placed in a pouch. Any plastic pouch which does not leak would be suitable. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis.

The folded carrier sheet/coversheet article is placed in the pouch. The folds can be of any type, e.g., an accordion-style fold, such that the final dimension of the folded sheet is about 13.5 cm×9.5 cm. This size is not critical but is convenient for placement in a pouch. 23 Grams of the liquid product are poured onto the carrier sheet/coversheet and allowed to absorb into it for a minimum of 30 minutes, preferably for about 4 hours. The pouch is sealed immediately after the liquid product is introduced into the pouch and stored until time-of-use.

As noted hereinabove, the carrier sheet can have holes punched therethrough in order to minimize its tendency to re-fold in-use. Indeed, the holes can be punched through the entire article, including the coversheet, itself, but this is not necessary. In a typical mode, for an article having the overall dimensions of about 27 cm×37 cm, 16 round holes, each about 0.5 in. (1.27 cm) in diameter are evenly spaced across the HYDRASPUN carrier sheet. The holes may be punched on the flat portions of the sheet, on the fold lines, or both. In a preferred mode, the holes are punched at the points where the fold lines intersect. Slits or other perforations may be used in like manner.

Step 1. A fabric to be cleaned and refreshed is selected. Localized stained areas of the fabric are situated over an absorbent stain receiver and are treated by directly applying about 0.5–5 mls (depending on the size of the stain) of the liquid product of Example II, III or IV. The treated stains are padded with dry paper toweling. In an alternate mode, the product is releasably absorbed on a carrier sheet and applied to the stains, which are then treated with a rubbing device, using a rocking motion, with hand pressure.

Step 2. Following the pre-treating step, the fabric is placed into a vapor-venting nylon bag with the sheet (which is removed from its storage pouch and unfolded) releasably containing the aforesaid cleaning/refreshment product. The mouth of the bag is closed to provide vapor-venting, and the bag and its contents are placed in the drum of a conventional hot air clothes dryer. The dryer is operated in standard fashion for 20–60 minutes at a high heat setting (an air temperature range of about 140°–170° F.; 60°–70° C.). After the tumbling action of the dryer ceases, the cleaned and refreshed fabric is removed from the bag. The used sheet is discarded. The fabric (which is preferably still slightly damp) is preferably hung on a conventional hanger to complete the drying process thereby further avoiding wrinkles.

EXAMPLE II

The optional pre-treating operation herein for removing stain from a localized area on a fabric can also be conducted by:

(a) underlaying the area containing said stain with an absorbent stain receiver;

(b) applying a fluid cleaner (pre-treating) composition to said stain from a container having a dispenser spout; and (c) rubbing or pressing said cleaning composition into said stain using the distal tip of said spout, whereby said stain is transferred into the stain receiver.

In this mode, the face of the distal tip of said spout can be concave, convex, flat, or the like. The combination of container plus pre-treating composition is referred to herein conjointly as the "dispenser".

A typical dispenser herein has the following dimensions, which are not to be considered limiting thereof. The volume of the container bottle used on the dispenser is typically 2 oz.–4 oz. (fluid ounces; 59 mls to 118 mls). The container larger size bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal tip of about 0.182 inches (4.6 mm). The diameter of the channel within the spout through which the pre-treating fluid flows is approximately 0.062 inches (1.57 mm). In this embodiment, the channel runs from the container bottle for a distance of about 0.474 inches (1.2 cm) and then expands slightly as it communicates with the concavity to form the exit orifice at the distal tip of the spout.

Pre-treating formulas for use herein with the aforesaid dispenser and a TBAL or FAM-foam stain receiver are given in Tables II A and B.

TABLE II A

| INGREDIENT | % (Wt.) (Nonionic) | Range % (Wt.) |
|---|---|---|
| Hydrogen peroxide | 1.000 | 0–2 |
| Amino tris(methylene phosphonic acid)* | 0.040 | 0–0.06 |
| Butoxypropoxypropanol (BPP) | 2.000 | 1–6 |
| Neodol 23 6.5 | 0.250 | 0–1 |
| Kathon preservative | 0.0003 | Optional** |
| Water | 96.710 | Balance |
| pH target = 7; range = 6–8 | | |

*Stabilizer for hydrogen peroxide
**Sufficient to provide a preservative function.

TABLE II B

| INGREDIENT | Nonionic (%) | Anionic (%) |
|---|---|---|
| Butoxypropoxypropanol (BPP) | 2.00 | 2.00 |
| NEODOL 23 6.5 | 0.250 | — |
| $NH_4$Coconut $E_1S$* | — | 0.285 |
| Dodecyldimethylamine oxide | — | 0.031 |
| $MgCl_2$ | — | 0.018 |
| $MgSO_4$ | — | 0.019 |
| Hydrotrope, perfume, other minors | — | 0.101 |
| KATHON preservative | 0.0003 | 0.0003 |
| Water | 97.750 | 97.547 |

*Ammonium salt of $C_{12}$–$C_{14}$ (coconut alkyl) ethoxy (EO-1) sulfate.

What is claimed is:

1. A non-immersion cleaning/refreshment method for treating a fabric article, wherein the fabric article has a first and second side with at least one water spot on the first side, which method comprises the steps of:

a) placing the fabric article together with an absorbent carrier substrate having a liquid cleaning/refreshment composition releasably absorbed in the substrate in a containment bag;

b) placing the bag in a hot air clothes dryer, and operating the apparatus with heat and tumbling;

c) removing the fabric article from the bag;

d) placing a clean cloth on a hard flat surface;

e) placing the fabric article on the clean cloth such that the first side of the fabric article contacts the clean cloth;

f) dampening the fabric article adjacent the water spot with an aqueous solution; and g) ironing the second side of the fabric article adjacent the water spot with a clothes iron.

2. The method of claim 1, wherein steps f) and g) are repeated.

3. The method of claim 1, wherein the fabric article is made from fabrics selected from the group consisting of silk, acetate, wool, linen, rayon and mixtures thereof.

4. The method of claim 1, wherein the hard flat surface is an ironing board and the clean cloth is a ironing board cover.

5. The method of claim 1, wherein the clean cloth is an adsorbent, light colored towel.

6. The method of claim 1, wherein the aqueous solution comprises water.

7. The method of claim 2, wherein before steps f) and g) are repeated the fabric article is moved so that the water spot contacts a dry area on the clean cloth.

8. A method according to claim 1, wherein vapors are vented from the bag during step b).

9. A method according to claim 1, further comprising the following two additional steps:

h) applying a pre-treating composition from a dispenser to a discrete stained area of the fabric article; and i) concurrently or consecutively with Step h), contacting the stained area of the fabric article with an adsorbent sheet adjacent the stained area.

* * * * *